United States Patent [19]

Whitcomb et al.

[11] Patent Number: 4,902,668

[45] Date of Patent: Feb. 20, 1990

[54] PRESSURE SENSITIVE CARBONLESS IMAGING SYSTEM INCORPORATING UNCOLORED FERRIC ORGANOPHOSPHATES AND COLORED CHELATES

[75] Inventors: David R. Whitcomb, Woodbury; Loren D. Albin, Oakdale, both of Minn.

[73] Assignee: Minnesota Mining and Manufacturing Company, St. Paul, Minn.

[21] Appl. No.: 236,658

[22] Filed: Aug. 25, 1988

[51] Int. Cl.[4] ..... B41M 5/16; B41M 5/22

[52] U.S. Cl. ..... 503/201; 427/150; 428/704; 428/914; 503/200; 503/211; 503/217; 503/226

[58] Field of Search ..... 427/150–152; 428/704, 913, 914, 201, 215, 216; 500/200, 211, 217, 226

[56] References Cited

U.S. PATENT DOCUMENTS

| | | | |
|---|---|---|---|
| 2,663,654 | 12/1953 | Miller et al. | 117/36 |
| 3,094,620 | 6/1963 | Reitter | 250/65 |
| 3,293,055 | 12/1966 | Baum | 106/171 |
| 3,516,941 | 6/1970 | Matson | 252/316 |
| 3,829,401 | 8/1974 | Futaki et al. | 260/38 |
| 3,846,153 | 11/1974 | Futaki et al. | 117/36.9 |
| 3,953,659 | 4/1976 | Truitt | 428/511 |
| 4,334,015 | 6/1982 | Yarian | 435/13 |
| 4,513,302 | 4/1985 | Braun | 346/210 |
| 4,531,141 | 7/1985 | Sagawa | 346/209 |
| 4,533,930 | 8/1985 | Shioi et al. | 346/211 |
| 4,602,264 | 7/1986 | Shioi et al. | 346/205 |
| 4,704,379 | 11/1987 | Shioi et al. | 503/211 |

OTHER PUBLICATIONS

Article entitled "The Infra-Red Spectra of Complexes of Beryllium with Tri-n-Octylphosphine Oxide and Di(2-Ethylhexyl)Phosphoric Acid," Smythe et al., *Journal of Inorganic Nuclear Chemistry*, vol. 30, pp. 1553–1561, (1968).

*Primary Examiner*—Bruce H. Hess

*Attorney, Agent, or Firm*—Donald M. Sell; Walter N. Kirn; Mark A. Litman

[57] ABSTRACT

Pressure sensitive imaging materials are stable until pressure addressed, but thereafter provide an intense dark image. The materials comprise colorless ferric organophosphate, ferric organophosphinate, or ferric organophosphonate and a colored chelate.

22 Claims, No Drawings

PRESSURE SENSITIVE CARBONLESS IMAGING SYSTEM INCORPORATING UNCOLORED FERRIC ORGANOPHOSPHATES AND COLORED CHELATES

BACKGROUND OF THE INVENTION

1. Field of the Invention

This invention relates to carbonless materials. More particularly it relates to pressure sensitive layers on substrates. Many existing compositions exhibit a yellow or brown color cast which is caused by the color of the reactive metal compounds contained therein. This invention uses compositions containing colorless iron salts which are reactable at room temperature to give a visible image.

In commercial applications, pressure sensitive labels are sought which not only provide visible images but which are also capable of being read by optical scanners using near infrared radiation (NIR). The images resulting from reacting the colorless iron salts with chelates having certain substituents exhibit good discrimination both visually and to NIR.

2. Background of the Art

For many years heat and pressure sensitive imaging sheets have been used for copying and labeling. Many of these materials involve the mixing of two or more physically separated reagents to cause a color forming reaction. Several general classes of color forming reactants have been used, of which two common ones are a) leuco lactone or spiropyran compounds reactable with phenolic compounds (e.g. U.S. Pat. No. 3,829,401 and U.S. Pat. No. 3,846,153) and b) heavy metal salts of organic acids reactable with ligands to give colored complexes (e.g. U.S. Pat. No. 2,663,654, U.S. Pat. No. 3,094,620, U.S. Pat. No. 3,293,055, U.S. Pat. No. 3,953,659, U.S. Pat. No. 4,334,015, U.S. Pat. No. 4,513,302, U.S. Pat. No. 4,531,141, U.S. Pat. No. 4,533,930 and U.S. Pat. No. 4,602,264).

Commercial preference for the heavy metal salt class has often resulted from the high stability and near black color of the images produced (U.S. Pat. No. 4,531,141). Of the heavy metals used, iron, nickel, and cobalt are common and ferric iron appears to be preferred U.S. Pat. No. 2,663,654, U.S. Pat. No. 3,953,659, U.S. Pat. No. 4,531,141, U.S Pat. No. 4,533,930 and U.S. Pat. No. 4,602,264)

The objection raised to the ferric salt-phenolic ligand systems is the colored nature of the unreacted ferric salt. This has led to the use of white fillers (U.S. Pat. No. 4,531,141) or other incident light scattering devices (e.g., "blushing" the surface of the layer as in U.S. Pat. No. 3,953,659) to reduce the observed color tint of the coated layer.

Recently, there has been interest in obtaining reactive iron salts which are colorless and which give sharp, high density images when reacted with a colorless ligand. Organophosphates of ferric iron are known in the art to be amongst the few colorless ferric salts (Smythe et al., J. Inorg. Nucl. Chem., 30 1553–1561, (1968)). In U.S. Pat. No. 4,533,930 and U.S. Pat. No. 4,602,264 it is disclosed that such organophosphates, and the equivalent thiophosphates, can react with a variety of ligands under the influence of heat or pressure to give colored results. Ferric salts of organophosphinic acids and organophosphonic acids are included in those disclosures. Some of these organophosphates and many of the thiophosphates have some color cast before reaction which appears to be obscured by the use of white filler in the compositions. In these two patents there are disclosed pressure sensitive manifold papers in which at least one of the two reactants is encapsulated as a solvent solution. When the microcapsules are burst by pressure, the reactants come into contact and immediately react at room temperature to give a colored result. These patents further disclose the use of ferric organophosphates containing organic acid moieties formed by the aqueous reaction of a ferric salt, an alkali metal organophosphate, and an alkali metal salt of an organic acid. These are disclosed as giving the initial material better "color forming properties" an giving better image colors (U.S. Pat. No. 4,533,930, Column 5, lines 38–39 and U.S. Pat. No. 4,602,264, Column 5, lines 7–9) than the simple organophosphates. Excess organic acid salt is disclosed as degrading the white color. It is of significance that the inventors do not consider the choice of the ferric salt used in the preparation to be important. In fact they specifically mention ferric chloride and ferric sulfate (U.S. Pat. No. 4,533,930, Column 6, lines 10–17 and U.S. Pat. No. 4,602,264, Column 6, lines 12–18) and all of their examples use ferric chloride.

SUMMARY OF THE INVENTION

This invention provides pressure sensitive imaging systems comprising reagents which are stable at room temperature but give intense dark colors when mixed together via pressure imaging.

The pressure sensitive imaging systems of the invention may take any of a variety of forms. However, each comprises at least two reactants which are physically separated until pressure is applied, at which point they mix and react with one another at room temperature to form a visible color. Typically the imaging system comprises two substrates arranged in an overlying adjacent relationship to one another with the surface of each substrate facing the other substrate coated with a layer containing a different one of two color-forming coreactants. The reactant containing layers may be solid or liquid and may consist of reactant alone or a solution or dispersion of the reactant. Furthermore, liquid solutions and dispersions of reactant may be encapsulated in pressure-rupturable microcapsules dispersed throughout a layer of film-forming binder material coated on the surface of the substrates. Alternatively, liquid solutions or dispersions of reactant, which may be microencapsulated, may be dispersed or otherwise contained within the substrate in lieu of a surface coating. In carbonless constructions, however, usually one substrate, referred to as a receptor substrate, is coated with a solid reactant containing layer comprising reactant alone or reactant dispersed in microparticulate form in a film-forming binder material; and the other substrate, referred to as a donor substrate, is coated with a layer of film-forming binder material having microcapsules containing a liquid solution or dispersion of the coreactant dispersed throughout.

Additionally, the imaging system may comprise a single substrate having coated thereon or dispersed therein two reacting coreactants, provided at least one of the reactants is microencapsulated as a liquid solution or dispersion to provide the required physical separation. The reactants may be contained in a single layer or in separate overlying adjacent layers coated on one surface of the substrate. Alternatively, the microencapsulated reactant may be dispersed within the substrate and the other reactant coated on the substrate's surface, or both reactants may be dispersed within the substrate. Furthermore, if the substrate is porous, the reactants may even be coated on opposite surfaces of the substrate.

One of the coreactants is a colorless iron containing compound chosen from the class of ferric iron complexes in which the ligand is chosen from organophosphates, organophosphinates and organophosphonates (hereinafter collectively referred to as organophosphates) which react with the second reactant at room temperature. The second reactant is chosen from the class of colored chelating agents having either neutral donors or at least one ionizable hydrogen, or both, and which form dark colored complexes with iron (III). Examples of suitable colored chelates include colored catechols, quinones, azo dyes and macrocyclic chelates.

Iron(III) is the preferred metal for the reaction with chelates since it is capable of oxidizing the chelate, and generating iron complexes that are both black in the visible and strongly absorbing in the near infrared.

The pressure sensitive receptor layers are typically coated or extruded from coating mixes using aqueous or non-aqueous solvents, which solvents enable efficient milling of the ferric organophosphates or chelates.

The pressure sensitive donor layers are typically coated from coating mixes containing microencapsulated coreactant in solution.

The use of colored chelates in the pressure sensitive imaging systems of the present invention provide imaging systems for producing a dark colored image on a colored substrate. These systems are particularly desirable for self-marking paper form sets in which a colorless original and a colored copy is desired. For example, if the donor (or original) substrate bears a coating containing microencapsulated colorless ferric iron compound and the receptor (or copy) substrate bears a coating of the colored chelate, a colorless original and a copy having a dark colored image on a colored background can be obtained upon pressure imaging without the addition of any other dyes or pigments to the paper base stock of the copy substrate.

Definitions:

"ferric organophosphate" compounds of the form $$Fe(O_2P(R)_2)_3$$

where R is an organic moiety such as alkyl, alkoxy, aryl, aryloxy, alkaryl, aralkyl, alicyclic groups, etc.

"ferric dialkylphosphate" as above where R is an alkyl moiety.

"chelate" in this case refers to a bidentate or polydentate ligand in which the coordinating groups can bind to the same metal ion.

DETAILED DESCRIPTION OF THE INVENTION

Carbonless transfer papers have come into wide usage over the past several years. Ordinarily, these papers are printed and collated into form sets for producing multiple copies. Impact on the top substrate causing each of the underlying substrates to form a mark thereon corrresponding to the mark applied by machine key or stylus on the top substrate, without carbon paper interleaves or carbon coatings. The top substrate, on which the impact is immediately made, usually has its back surface coated with tiny microscopic capsules containing an active ingredient for mark production. A receptor substrate placed in contact with the back face of the top substrate has its front surface coated with a material having a component reactive with the contents in the capsules. When the capsules are ruptured upon impact by stylus or machine key, the contents of the ruptured capsules react with a coreactant therefor on the receptor substrate forming a mark on the receptor substrate corresponding to the mark impressed by the stylus or machine key. These self-marking impact transfer papers are designated by the terms CB, CFB and CF, which stand respectively for "Coated Back", "Coated Front and Back", and "Coated Front". The CB substrate is usually the top substrate having its back surface coated with the microcapsules, and it is this substrate on which the impact impression is directly made. The CFB substrates are the intermediate substrates which form a mark on the front surface thereof and transmit the contents of ruptured capsules from the back surface thereof to the front of the next succeeding substrate. The CF sheet is the bottom substrate and is only coated on the front surface to form an image thereon, as no further transfer is desired.

As indicated above, carbonless transfer papers comprise two physically separate coreactants which react upon contact to form a dense colored image. Usually, one of the reactants is dissolved in a reaction implementing cosolvent vehicle and encapsulated in substantially pressure-rupturable microcapsules which are coated on the surface of a substrate. A solution or dispersion of the coreactant is coated on a second substrate, the copy sheet, and dried. The substrates containing the coating of microcapsules and the coating of coreactant are then placed in such a relationship to each other that rupture of the capsules will release the entrapped contents and allow the coreactants to react thereby forming a dense colored image. While it is customary to coat the capsules on the back surface of the overlying substrate and coat the coreactant for the encapsulated reactant on the front surface of the substrate upon which the image is to be copied, this procedure could be reversed if desired. Alternatively, both reactants may be encapsulated and located either on adjacent substrates in superimposable relationship or on the same surface of a single substrate. Additionally, the microcapsules are so rugged and impervious to the coreactants that microcapsules containing one reactant may be interspersed with a fluid suspension or solution of the coreactant and applied to a surface as a single coating with little danger of premature image formation.

Furthermore, the capsules need not be applied as layers, but may be subjected to the rigors of paper formation on a paper machine and can be directly incorporated into the paper, the capsules being carried as a filler therewithin. Similarly, the coreactant can be incorporated into a second or copy surface or may be carried adjacent to the capsules in the same web of paper.

Alternatively, a composition comprising a solution or dispersion of one reactant can be carrried by a variety of materials such as woven, non-woven or film transfer ribbons for use in impact marking systems such as typewriters and the like, whereby the reactant is transferred to a coreactive record surface by impact transfer means. Furthermore, a composition comprising a solution or dispersion of one of the reactants could be absorbed in a porous pad for subsequent transfer to a coreactive record surface by a transfer means such as a portion of the human body, e.g., a finger, palm, foot or toe, for providing fingerprints or the like.

As noted above, the color-forming composition of the present invention can be readily microencapsulated by techniques known in the art, such as those described in "Microcapsule Processing and Technology," A. Kodo, Marcel Dekker, Inc. (1979); "Capsule Technology and Micro-encapsulation," M. Gutcho, Noyes Data Corporation and as described in U.S. Pat. No. 3,516,941.

Capsules containing a reactant of the present invention may be formed from any substantially impermeable film-forming material sufficiently strong to withstand necessary handling. A suitable class of film-forming materials are aldehyde condensation polymers, particularly urea-aldehyde condensation polymers, and more particularly urea-formaldehyde condensation polymers. The capsules are preferably in a size range of from 1 to 50 microns and are preferably used in an amount from 5 to about 50 parts by weight dry capsules per 100 parts pulp when incorporated within the body of paper substrates.

The color-forming system of the present invention requires two coreactants, a colored chelate and a colorless iron (III) organophosphate. As used herein, "colorless" is an indication that upon reflective or transmissive observation of the composition (depending upon the nature of the substrate upon which the composition is coated, i.e., opaque or transparent) the human eye observes a "true white" rather than a colored tone. For example, there would be no clear yellow, pink, or blue tones in the observed material. In the transmissive mode this would require that the composition not absorb significantly more strongly in one or more 25–50 nm ranges of the visible portion of the electromagnetic spectrum than in other 25–50 nm ranges within the visible portion of the electromagnetic spectrum. Small percentage variations are of course tolerable so long as the eye does not observe them. This is usually exemplified by having an optical density of less than 0.2 in a 50 nm range in the visible portion of the electromagnetic spectrum. These kind of measurements can readily be taken by densitomiters in reflective or transmissive mode. Some optical brighteners tend to add coloration (in particular blue) at an optical density level of less than 0.05. This is acceptable, but not preferred. Optical densities which vary in any 50 nm range within the visible portion of the electromagnetic spectrum by more than 0.1 are not preferred; it is desirable that any variation be less than 0.05.

It is an important feature of the present invention that the liquid employed as the solvent for the encapsulated reactant may be a solvent for the coreactant but need not be. If the liquid is a solvent for both reactants, then it serves as a reaction implementing medium for the two reactants at the time of rupture of the capsules, and is commonly referred to as a cosolvent. Examples of cosolvents include cyclohexane, tributyl phosphate, diethyl phthalate, toluene, xylene, 3-heptanone and the like. The selection of additional suitable cosolvents will be obvious to those skilled in the art.

U.S. Pat. No. 4,533,930 and U S. 4,602,264 disclose a wide range of ferric salts of organo phosphorus oxyacids and thioacids as useful in pressure sensitive and thermographic reactions with a range of ligands. They are presented as giving much whiter backgrounds than ferric salts previously used in this art. It is clear from the examples, and confirmed from our own investigations, however, that the organothiophosphates are highly colored and dark. Furthermore, many of the examples using organophosphates, disclosed in these patents, record appreciable coloration of the compounds with whiteness levels being achieved by the use of fillers such as zinc oxide, aluminum hydroxide, and calcium carbonate.

This invention defines a preferred narrow range of ferric organophosphates which are entirely colorless. The structural formulae of some of these compounds (I) are encompassed generically by the disclosures of U.S. Pat. No. 4,533,930 and U.S 4,602,264 without any means of providing them as truly colorless species being disclosed. Other structures within this invention are not even generically disclosed (II–IV). These compounds are dialkylphosphates, dialkylphosphinates, and dialkylphosphonates (hereinafter collectively referred to as dialkylphosphates) and have structures chosen from the general formulae:

$$Fe(O_2PR_2)_3 \quad \text{I}$$
$$Fe(O_2PR_2)_3.X \quad \text{II}$$
$$Fe(O_2PR_2)_3(HO_2PR_2)_3 \quad \text{III}$$
$$Fe(O_2PR_2)_3(HO_2PR_2)_3.X \quad \text{IV}$$

in which each R is selected independently from alkyl or alkoxy groups and substituted alkyl or alkoxy groups bearing substituents such as those selected from alkyl, cycloalkyl, and aryl provided that such substituents do not act as ligands or chelates for ferric ions; and X is a counterion.

Preferably R is selected from the group represented by the formula:

$$-O_d-(CH_2)_a-\underset{}{\overset{(CH_2)_c-H}{\overset{|}{CH}}}-(CH_2)_b-H$$

where d=0 or 1, b>a, b>c, c is 1 to 10, and 3<a+b<18; and X is selected from $F^-$, $PF_6^-$, $Ph_4B^-$, $BF_4^-$ and $NO_3^-$ (where Ph=phenyl). In our most preferred compounds a=1, b=4, c=2, d=1 and $X=NO_3^-$.

Dialkylphosphates are the preferred ligand for iron(III) since the resulting complexes are completely colorless. If trialkylphosphates are used as the main ligand, sufficiently stable iron complexes do not form, and if monoalkylphosphates (as well as inorganic phosphates) are used, generally undesirable, extensive crosslinking occurs between metal centers such that the resulting iron organophosphate is too stable to react with the chelate. Previously used iron carboxylates typically are too highly colored and cannot produce colorless backgrounds. Mixed dialkylphosphate/carboxylate iron complexes can be made to be less colored than iron carboxylates, but they still retain undesirable color because of the presence of the carboxylate. The iron complexes of the sulfur analogues of the carboxylates, phosphates, and their mixtures are particularly undesirable since they are highly colored, even black, materials. Aromatic phosphates often provide an iron complex that is less reactive and more colored than the dialkylphosphates.

Ferric propyl(2-ethylhexyl)phosphinate, ferric cyclohexyl(2-ethylhexyl)phosphinate, and ferric dicyclohexylphosphinate have been made and found to be reactive with chelates. The most preferred organophosphate ligands, however, are branched chain dialkylphosphates, especially di-2-ethylhexylphosphate (DEHP). Linear chain dialkylphosphates form colorless iron complexes that give images with chelates but are generally too unreactive (too highly crosslinked) to provide sufficient image density. The branch on the main chain should be sufficiently long and sufficiently close to the metal center that crosslinking between metal centers is inhibited. On the other hand, the branch should not be too long or too close to the phosphorus center since iron that is incompletely reacted with the phosphate may result in a colored iron source. From a practical aspect, the ideal structure is illustrated by DEHP. The range for the side chain length might best be put at about 1–10 carbon atoms, the further from the connection point to the phosphorous the longer the chain. The length of the main chain is best illustrated by DEHP, that is, around 6–10 carbon atoms. Chains as long as 18 carbon atoms are the practical maximum due to the required loading necessary to achieve suitable optical density (i.e., the molecular weight of the non-image contribution of the organic moiety becomes impractically high).

$Fe(DEHP)_3$, $Fe(DEHP)_3(NO_3)$, $Fe(DEHP)_3(HDEHP)_3$ and $Fe(DEHP)_3(HDEHP)_3(NO_3)$ are preferred in the iron organophosphate series. These are completely colorless, a major improvement over the iron carboxylates and mixed carboxylate/organophosphate iron complexes. In addition, unlike the general straight chain dialkylphosphate iron complexes, they are very reactive with chelating ligands. The latter three are also soluble in the organic solvents used in the microencapsulation process and can, therefore, be microencapsulated on donor sheets for pressure-sensitive imaging constructions.

We have found that the preparation of the colorless ferric organophosphate compounds of I is not as simple as U.S. Pat. No. 4,533,930 and U.S. Pat. No. 4,602,264 suggests. Their method involves mixing aqueous solutions of an alkali metal salt of the organophosphoric acid and a ferric salt of a strong mineral acid such as hydrochloric and sulfuric acids, which results in a precipitate of the ferric organophosphate. It has been found that ferric chloride (which is preferred by these patents) gives slightly colored precipitate even with dialkylphosphates whereas those from ferric nitrate are completely colorless. The preferred preparation, therefore, uses ferric nitrate to give compounds I–IV.

Ferric dialkylphosphate compounds II where X=fluoride, hexafluorophosphate, tetraphenylborate or tetrafluoroborate may be prepared by mixing required equivalent quantities in aqueous solution of ferric nitrate, alkali metal salt of the dialkylphosphoric acid, and the alkali metal salt of the acid HX. Compounds II then precipitate.

When X=nitrate, however, the nitrate ion is too soluble in water to remain attached to the ferric dialkylphosphate and the result is the compound I again. However, if the ferric nitrate and dialkylphosphoric acid are dissolved in glacial acetic acid, then compound II for X=nitrate is precipitated. This compound and the fluoride may also be prepared using ethyl alcohol as solvent and adding potassium acetate or sodium fluoride to the ferric nitrate and alkali metal phosphate in required equivalent amounts.

Ferric dialkylphosphate compounds III and IV may be prepared by mixing together the required equivalent quantities of an aqueous solution of ferric nitrate and an organic solution of the dialkylphosphoric acid, or its alkali metal salt, and extracting into the organic solution. Alternatively, compounds III and IV may be prepared directly in non-aqueous solution.

The chelate compounds which we select as pressure-activated reactants with these iron compounds are chosen to be colored, to react rapidly with the iron compounds at room temperature and to be easily soluble in organic solvents. These colored chelates are selected from aromatic or alkyl ligands having either neutral donors or at least one ionizable hydrogen, or both, and which react with iron (III) to form colored complexes. Examples of chelates meeting these criteria include the colored catechols, quinones, azo dyes, macrocylic compounds and the like. Furthermore, colored mixtures comprising one or more of these colored chelates and one or more colorless chelates having either neutral donors or at least one ionizable hydrogen, or both, and which react with iron (III) to form colored complexes are useful in the pressure sensitive imaging systems of the present invention. For example, intense dark images displaying good discrimination to NIR can be formed by reacting the colorless iron compound with a mixture comprising one of the colored chelates described above and a colorless substituted catechol bearing electron donating groups. Commonly known electron donating groups (such as alkyl, mono- or dialkyl substituted amino, alkoxy, etc.) enable the catechol to be oxidized more readily by the iron, which is important for obtaining the infrared absorption properties (at 905 nm in particular) needed for bar code readers.

A carbonless recording donor substrate of the invention can be made in the following manner. The chelate or the organic solvent soluble ferric dialkylphosphates of (II–IV) are dissolved in an organic solvent and encapsulated by methods known in the art. The pressure rupturable microcapsules so formed are dispersed throughout a suitable binder material to form a coating composition. The coating composition is then coated on a suitable substrate and dried.

A carbonless recording receptor substrate of the invention can be prepared as follows. The coreactant for the reactant encapsulated on the donor substrate is dissolved or dispersed in microparticulate form throughout a suitable solvent to form a coating composition. When the encapsulated reactant is the chelate, the coating composition may comprise solid ferric dialkylphosphate (I–II) dispersed throughout or dissolved in a solvent such as water, acetone, methyl ethyl ketone, ethanol, etc. or organic solutions of ferric dialkylphosphates (II–IV). When the encapsulated reactant is one of the organic solvent soluble ferric dialkylphosphates, the coating composition is an aqueous dispersion or solution, or an organic solution of the chelate. The coating composition is coated on a suitable substrate and dried.

Substrates which may be used as carbonless recording substrates are films of transparent, opalescent, or opaque polymers, paper, optionally with white or colored surface coatings, glass, ceramic, etc.

The following are preparative examples for the ferric dialkylphosphates I, II, and IV.

EXAMPLE A

Preparation of $Fe(DEHP)_3$

1. The method is similar to the literature preparation of L. E. Smythe, T. L. Whateley and R. L. Werner, J. Inorg. Nucl. Chem., 30, 1553 (1968) (but using ferric nitrate instead of ferric sulfate). To 2.0 g KOH in 175.0 ml $H_2O$ is added 10.0 g DEHP. This solution is added over 5 minutes to 35.0 ml of water containing 4.0 g $Fe(NO_3)_3 \cdot 9H_2O$ with vigorous stirring. The mixture is stirred 10 minutes, filtered, washed in fresh water with stirring, filtered and dried under vacuum at 70° C. to a constant weight. An off-white solid is obtained . The infrared spectrum shows the expected phosphate stretches, as well as small amounts of OH, and the characteristic ethyl group presence at 1466.1 $cm^{-1}$.

EXAMPLE B

Preparation of $Fe(DEHP)_3(NO_3)$

Powdered $Fe(NO_3)_3 \cdot 9H_2O$, 80.8 g, is dissolved in 800 ml glacial acetic acid. As soon as a clear solution is obtained, 193.0 g bis-(2-ethylhexyl) phosphate (DEHP) is added in a rapid dropwise manner with vigorous stirring. Less than a stoichiometric amount of DEHP gives a more colored product; an excess of DEHP is not disadvantageous. The white product is filtered, washed with acetic acid and dried under vacuum. The approximate yield is 84%. The product is found to be rubbery and may be recrystallized by precipitation from cyclohexane by acetone. It is important that $FeCl_3$ not be used since a clear yellow acetic acid solution results.

Alternative preparation from ethanol: To 40 ml of absolute ethanol is added 2.0 g $Fe(NO_3)_3 \cdot 9H,0$. Upon dissolution, 5.0 g DEHP are added, and the clear solution stirred 5 minutes. An aqueous solution of potassium acetate (0.5 g in 4.5 g $H_2O$) is added dropwise. The mixture is stirred 2 minutes, filtered, redispersed in water, stirred an additional 20 minutes, filtered and vacuum dried. The infrared spectrum is identical to that prepared from acetic acid.

Characterization: The infrared spectrum clearly shows the coordinated organophosphate (1000–1200 $cm^{-1}$) and nitrate (1551.0 $cm^{-1}$ asymmetric stretch, the symmetric stretch is under other peaks), and the absence of Fe-O-Fe stretches. The complex is readily soluble in cyclohexane, and is an excellent film forming material when coated on a substrate (clear, colorless film). Elemental analysis is consistent with the presence of one nitrate, and confirms the 3:1 P:Fe ratio. Magnetic susceptibility determined by the Evan's NMR method (J. Chem. Soc., 2003 (1959)), demonstrates a high spin iron complex. The complex was also found to be conductive in cyclohexane solution.

EXAMPLE C

Preparation of $Fe(DEHP)_3F$

1. To 500.0 g $H_2O$ is added 6.0 g KOH. To a separate 500.0 g $H_2O$ is added 12.0 g $Fe(NO_3)_3 \cdot 9H_2O$ followed by 0.62 g NaF. To the aqueous base solution is added 32.0 g DEHP, which is then added rapidly to the mechanically stirred iron solution. The pure white iron complex is filtered, washed and vacuum dried.

2. To 300 ml ethanol is added 16.13 g $Fe(NO_3)_3 \cdot 9H_2O$. Upon dissolution, 40.0 g DEHP is added rapidly dropwise (3 minutes). The clear solution is stirred 5 minutes then 3.2 g NaF in 32 g $H_2O$ are added dropwise (5 minutes). The white solid is stirred, then diluted with 400 ml $H_2O$, stirred 30 minutes and filtered. A colorless solid results. Elemental analysis is consistent with a 3:1:1 P:Fe:F ratio.

EXAMPLE D

Preparation of $Fe(DEHP)_3$(tetraphenylborate)

To 1.1 g sodium tetraphenylborate and 1.0 g $Fe(NO_3)_3 \cdot 9H_2O$ in 40 ml $H_2O$ is added rapidly 3.2 g DEHP and 0.73 g KOH in 80 ml $H_2O$. The mixture is filtered, dispersed in water, stirred, filtered and air dried. The infrared spectrum is consistent with the proposed material.

EXAMPLE E

Preparation of ferric n-propyl(2-ethylhexyl)phosphinate

To a solution of 25 g of n-propyldichlorophosphineoxide in 300 ml of petroleum ether, 28 g of diethylamine in 150 ml of petroleum ether was added over 4 hours. The petroleum ether was removed by distillation and the remaining n-propyl(diethylamine) chlorophosphineoxide was distilled off under vacuum.

The Grignard of 1-bromo-2-ethylhexane (31 g) was prepared in ether, and 26.4 g of the n-propyl(diethylamine)chlorophosphineoxide was added to it at room temperature and refluxed for 72 hours. The resulting solution was treated with 5M hydrochloric acid and refluxed overnight. On cooling the n-propyl(2-ethylhexyl)phosphinic acid was extracted with petroleum ether and distilled to give a colorless liquid (B.P. = 172–180° C. at 12 mm Hg).

To 1.3 g of $Fe(NO_3)_3 \cdot 9H_2O$ dissolved in 5 g of glacial acetic acid, 2.7 g of the prepared organophosphinic acid was added. This solution was diluted with 9 parts of water rapidly. The ferric n-propyl(2-ethylhexyl)phosphinate appeared as a white solid precipitate which was filtered off, washed with water, and dried in air.

EXAMPLE F

Preparation of ferric dicyclohexylphosphinate

The dicyclohexylphosphinic acid was made by the method disclosed in D. F. Peppard, G. W. Mason, and C. M. Andrijasich, J. Inorg. Nucl. Chem., 27, 697 (1965). Phosphinic acid, 2.35 g, was dissolved in a solution of 0.66 g of KOH in 10 g of water. This solution was diluted with 50 ml of water and added rapidly to a solution of 1.3 g of $Fe(NO_3)_3 \cdot 9H_2O$ in 50 ml of water. A fine yellow precipitate occured which was filtered off, washed with water, and air dried to give the ferric dicyclohexylphosphinate.

EXAMPLE G

Preparation of ferric cyclohexyl(2-ethylhexyl)phosphinate

Using the method described in Example E, 30 g of cyclohexyldichlorophosphineoxide was used in place of the n-propyldichlorophosphineoxide to give a thick colorless oil. The white ferric cyclohexyl (2-ethylhexyl)phosphinate was obtained by the treatment described in Example F.

EXAMPLE H

Preparation of $Fe[OOP(OR)_2]_3[HOOP(OR)_2]_3NO_3$

To a solution of 4.04 g $Fe(NO_3)_3 \cdot 9H_2O$ in 50 ml of ethanol was added a solution containing 0.56 g KOH and 19.66 g DEHP dissolved in 100 ml ethanol. This will yield a substantially colorless solution species having the formula $Fe(DEPH)_3(HDEPH)_3 \cdot NO_3$

EXAMPLE I

The iron(III)-organophosphate used in the following preparations was prepared according to example B.

1. Encapsulation of $Fe(DEHP)_3(NO_3)$ To 126 g of a 10% solution of $Fe(DEHP)_3(NO_3)$ in xylene was added 27 g of a polyphenylmethylene diisocyanate (commercially available from the Mobay Company under the trade designation Mondur MRS). This solution was then added to a one liter baffled reactor containing a solution of 1 g of a polyvinylpyrrolidone polymer (commercially available from the GAF Company under the trade designation PVP-30) in 500 g of water. The mixture was homogenized at 7000 rpm for 2 minutes with a Tekmar mixture equipped with a G-456 head. After homogenizing, the G-456 head was replaced with a Waring Blender blade and the mixture stirred at 2300 rpm. While the mixture was being stirred at 70° C., 77 ml of a 25% tetraethylenepentamine (TEPA) solution was added to the mixture. The mixture was then stirred for a period of 1 hour. At this point, microscopic investigation demonstrated the presence of microcapsules ranging in size from 2–20 microns.

2. Reaction of $Fe(DEHP)_3(NO_3)$ with colored chelates. The results of breaking the microcapsules prepared in 1 against a paper receptor sheet coated with the following colored chelates was:

| Chelate | Chelate Color | Image Color |
|---|---|---|
| 1-(2-pyridylazo)-2-naphthol | bright orange | purple-black |
| 1,8-dihydroxy-4,5-dinitro-anthraquinone | bright yellow | violet |
| 1,2-naphthquinone | tan-brown | grey |
| 1-hydroxy-4-aminoanthraquinone | purple | blue |
| N,N'-bis(salicylidene)-1,3-propanediamine | yellow | red |
| 4-nitrocatechol | bright yellow | grey-black |

3. Reaction of $Fe(DEHP)_3(NO_3)$ with mixtures of colored and uncolored chelates. The results of breaking the microcapsules prepared in 1 against a paper receptor sheet coated with the following mixtures of colored and colorless chelates was:

| Chelate Mixture | Color of Chelate Mixture | Image Color | Print Contrast Ratio |
|---|---|---|---|
| 50%A and 50%B | bright orange | purple-black | 0.32 |
| 50%A and 50%C | bright orange | black | 0.46 |
| 50%A and 50%D | bright orange | black | 0.65 |
| 25%A and 75%D | bright orange | black | 0.80 |

wherein:

A was 1-(2-pyridylazo)-2-naphthol (colored),

B was 8-hydroxyquinoline (colorless),

C was 6-t-butyl-3-methyl-catechol (colorless),

D was 3-iso-propyl-6-methyl-catechol (colorless), and $$\text{Print Contrast Ratio} = \frac{(\text{background reflectance} - \text{image reflectance})}{(\text{background reflectance})}$$

measured at 905 nm.

What is claimed is:

1. A pressure sensitive imaging system comprising a substrate having coated on one surface thereof or disposed therein a first component comprising a colored chelate selected from aromatic or alkyl ligands having either neutral donors or at least one ionizable hydrogen, or both, and which react with iron (III) to form colored complexes;, and a second component in such physical relationship with said substrate that said second component will contact said first component upon the application of pressure to said substrate, said second component comprising a colorless ferric iron compound selected from ferric organophosphates, ferric organophosphinates, and ferric organophosphonates which react with said colored chelate upon contact to form a visible color.

2. A pressure sensitive imaging system as recited in claim 1 wherein said colorless ferric iron compound is selected from $$Fe(O_2PR_2)_3 \quad \text{(I)}$$
$$Fe(O_2PR_2)_3.X \quad \text{(II)}$$
$$Fe(O_2PR_2)_3(HO_2PR_2)_3 \quad \text{(III)}$$
$$Fe(O_2PR_2)_3(HO_2PR_2)_3.X \quad \text{(IV)}$$

where each R is independently selected from alkyl or alkoxy groups and substituted alkyl or alkoxy groups bearing substituents selected from alkyl, cycloalkyl, and aryl groups, provided that said substituents do not act as ligands or chelates for ferric ions; and X is a counterion.

3. A pressure sensitive imaging system as recited in claim 2 wherein each R is selected independently from the group represented by the formula $$O_d-(CH_2)_a-\underset{}{\overset{(CH_2)_c-H}{\overset{|}{CH}}}-(CH_2)_b-H$$

where: $3<=a+b<=18$, $b>a$, $b>c$, $1<=c<=10$, $d=0$ or 1, and X is selected from fluoride, hexafluorophosphate, tetraphenylborate, tetrafluoroborate and nitrate.

4. A pressure sensitive imaging system as recited in claim 3 wherein $a=1$, $b=4$, $c=2$, $d=1$, and X=nitrate.

5. A pressure sensitive imaging system as recited in claim 4 wherein said first component further comprises a colorless chelate selected from aromatic or alkyl ligands having either neutral donors or at least one ionizable hydrogen, or both, and which react with iron (III) to form colored complexes.

6. A pressure sensitive imaging system as recited in claim 5 wherein said colorless chelate is a substituted catechol bearing electron donating groups.

7. A pressure sensitive imaging system as recited in claim 4 wherein said colored chelate is selected from the group consisting of catechols, quinones, azo dyes and macrocyclic chelates.

8. A pressure sensitive imaging system as recited in claim 4 wherein at least one of said colored chelate or said colorless ferric iron compound is encapsulated, as a liquid solution or dispersion, in pressure-rupturable microcapsules, and said second component is dispersed within said substrate.

9. A pressure sensitive imaging system as recited in claim 4 wherein at least one of said colored chelate or said colorless ferric iron compound is encapsulated, as a liquid solution or dispersion, in pressure-rupturable microcapsules, and said second component is coated on one surface of said substrate.

10. A pressure sensitive imaging system as recited in claim 4 further comprising a second substrate having said second component coated on one surface thereof or dispersed therein.

11. A pressure sensitive imaging system as recited in claim 10 wherein said first component and said second component are coated on the surfaces of said respective substrates facing one another.

12. A pressure sensitive imaging system as recited in claim 10 wherein at least one of said colored chelate or said colorless ferric iron compound is encapsulated, as a ligand solution or dispersion, in pressure-rupturable microcapsules, and at least one of said first component or said second component is dispersed within its respective substrate.

13. A pressure sensitive imaging system as recited in claim 1 wherein said colored chelate is selected from the group consisting of catechols, quinones, azo dyes and macrocyclic chelates.

14. A pressure sensitive imaging system as recited in claim 1 wherein said first component further comprises a colorless chelate selected from aromatic or alkyl ligands having either neutral donors or at least one ionizable hydrogen, or both, and which reacts with iron (III) to form colored complexes.

15. A pressure sensitive imaging system as recited in claim 14 wherein said colorless chelate is a substituted catechol bearing electron donating groups.

16. A pressure sensitive imaging system as recited in claim 1 wherein at least one of said colored chelate or said colorless ferric iron compound is encapsulated, as a liquid solution or dispersion, in pressure-rupturable microcapsules, and said second component is dispersed within said substrate.

17. A pressure sensitive imaging system as recited i claim 1 wherein at least one of said colored chelate or said colorless ferric iron compound is encapsulated, as a liquid solution or dispersion, in pressure-rupturable microcapsules, and said second component is coated on one surface of said substrate.

18. A pressure sensitive imaging system as recited in claim 1 further comprising a second substrate having said second component coated on one surface thereof or dispersed therein.

19. A pressure sensitive imaging system as recited in claim 18 wherein said first component and said second component are coated on the surfaces of said respective substrates facing one another.

20. A pressure sensitive imaging system as recited in claim 18 wherein at least one of said colored chelate or said colorless ferric iron compound is encapsulated, as a liquid solution or dispersion, in pressure-rupturable microcapsules, and at least one of said first component or said second component is dispersed within its respective substrate.

21. A method of generating a visible image on the surface of a substrate, said image comprising a representation of the characteristic pattern of raised and recessed portions of the external surface of the skin covering the hands, fingers, feet and toes of the human body, comprising:

(a) providing a first substrate, selected from the group consisting of the hands, fingers, feet and toes of the human body, having coated thereon a component comprising a colored chelate selected from aromatic or alkyl ligands having either neutral donors or at least one ionizable hydrogen, or both and which react with iron (III) to form colored complexes;

(b) providing a second substrate having coated thereon a component comprising a colorless ferric iron compound selected from ferric organophosphates, ferric organophosphinates and ferric organophosphonates which react with said colored chelate upon contact to form a visible color; and (c) pressing said first and second substrates together such that said colored chelate contacts said colorless ferric iron compound and reacts therewith to form a visible colored image on the surface of said second substrate comprising a representation of said characteristic pattern on the surface of said first substrate.

22. A method of generating a visible image on the surface of a substrate, said image comprising a representation of the characteristic pattern of raised and recessed portions of the external surface of the skin covering the hands, fingers, feet and toes of the human body, comprising:

(a) providing a first substrate having coated thereon a component comprising a colored chelate selected from aromatic or alkyl ligands having either neutral donors or at least one ionizable hydrogen, or both, and which react with iron (III) to form colored complexes;

(b) providing a second substrate, selected from the group consisting of the hands, feet, fingers and toes of the human body, having coated thereon a component comprising a colorless ferric iron compound selected from ferric organophosphates, ferric organophosphinates and ferric organophosphonates which react with said colored chelate upon contact to form a visible color; and (c) pressing said first and second substrates together such that said colored chelate contacts said colorless ferric iron compound and reacts therewith to form a visible colored image on the surface of said first substrate comprising a representation of said characteristic pattern on the surface of said second substrate.

* * * * *

UNITED STATES PATENT AND TRADEMARK OFFICE

CERTIFICATE OF CORRECTION

PATENT NO. : 4,902,668

DATED : February 20, 1990

INVENTOR(S) : Whitcomb and Albin

It is certified that error appears in the above-identified patent and that said Letters Patent is hereby corrected as shown below:

Column 6, lines 38 and 39, "3<a+b<18" should be --3<=a+b<=18--.

Column 9, line 28, ".9H,O" should be --.9$H_2O$--.

Column 10, line 29, "12 mm" should be --0.12 mm--.

Claim 1, column 11, line 68 - column 12, line 1, "disposed" should be --dispersed--.

Signed and Sealed this

Twenty-eighth Day of May, 1991

*Attest:*

HARRY F. MANBECK, JR.

*Attesting Officer*

*Commissioner of Patents and Trademarks*